United States Patent [19]

Kintish et al.

[11] 3,964,392

[45] June 22, 1976

[54] LAND MINE (U)

[75] Inventors: Irving L. Kintish, Rockaway; Irwin Marcus, Pompton Plains, both of N.J.

[73] Assignee: The United States of America as represented by the Secretary of the Army, Washington, D.C.

[22] Filed: Sept. 1, 1967

[21] Appl. No.: 666,235

[52] U.S. Cl. ..... 102/8; 102/22; 89/1 G

[51] Int. Cl.[2] ..... F42B 23/16

[58] Field of Search ..... 102/8, 22, 23, 24; 89/1 G

[56] References Cited

UNITED STATES PATENTS

| | | | |
|---|---|---|---|
| 2,440,702 | 5/1948 | Short | 102/8 |
| 2,812,710 | 11/1957 | Tyson | 102/8 |
| 3,218,972 | 11/1965 | Loving et al. | 102/22 |
| 3,242,862 | 3/1966 | Stegbeck et al. | 89/1 M |

*Primary Examiner*—David H. Brown
*Attorney, Agent, or Firm*—Nathan Edelberg; Robert P. Gibson; A. Victor Erkkila

[57] ABSTRACT

A coiled explosive ribbon having a plurality of fragments affixed thereto and contained in a circular container; the container includes projecting means secured to one end of the ribbon and detonating means secured to the other end of the ribbon. The mine further inciudes launching means secured to the projecting means.

10 Claims, 3 Drawing Figures

INVENTORS
Irving L. Kintish
Irwin Marcus

BY Harry M. Saragovitz, Edward J. Kelly, Herbert Berl & S. Dabroff
ATTORNEYS

LAND MINE (U)

The invention relates to a land mine and more particularly to a land mine having a spring-up type explosive.

In the past, the lethal probability of land mines was limited to a small area. The person or vehicle, depending on the type and size of the mine, triggering the mine would be the only target destroyed.

These mines propelled all of their fragments laterally and the intended victim, if alert, could prostrate himself upon hearing the pop of the propelling charge and escape injury because the fragments passed over his head.

The invention involves a thrusting spiral and as such, the fragment pattern is directed up and down and sideways making such evasive behavior ineffective. Furthermore, the present invention may be fired at any preselected level above the ground so that various effective areas and patterns can be obtained.

It is an object of the present invention to provide a land mine that greatly increases the area of lethality.

Another object of the invention is the provision of a land mine that is lethal to more than one person.

A further object of the invention is to provide a land mine which has a small size coupled with high kill potential.

The above objects as well as others together with the benefits and advantages of the invention will be apparent upon reference to the detailed description set forth below, particularly when taken in conjunction with the drawings annexed hereto in which.

As seen in the preferred embodiment of the drawings, the land mine 10 consists of a non-metallic circular container 12, which is approximately the size of a typewriter ribbon case, having a coiled up ribbon 14 of sheet explosive, which can be made of pentaerythritol tetranitrate (PETN). The container is non-metallic so that the user has an option to use non-metallic fragments (aluminum oxide cubes or balls) or metal fragments depending upon whether or not he desires the mine to be detected. Attached to both sides of the ribbon 14 are a plurality of metallic fragments or pellets 16.

Figure 1:
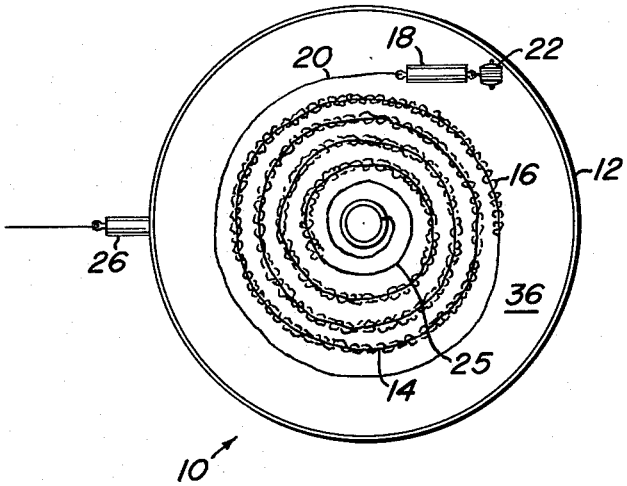
FIG. 1 illustrates a top plan view of the invention in its set condition.
Figure 2:
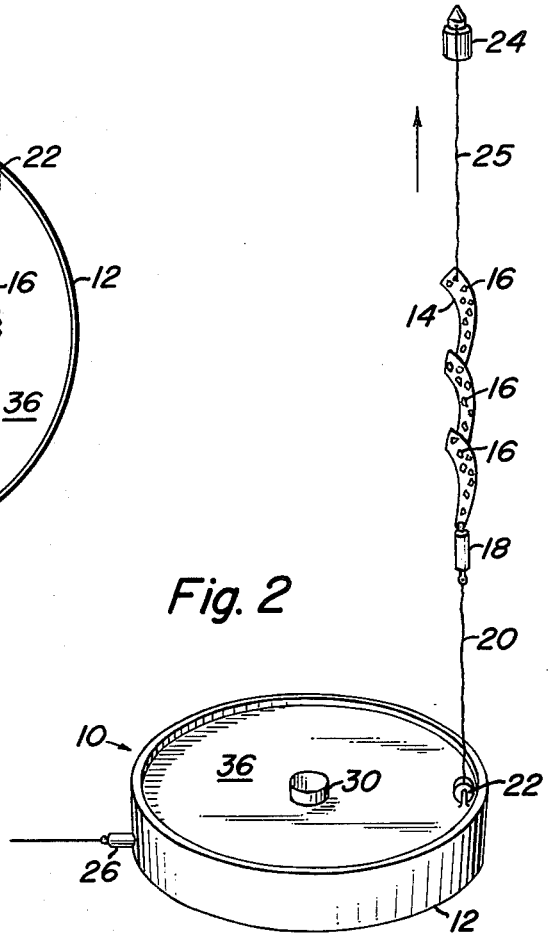
FIG. 2 illustrates an isometric view of the invention in its predetonated condition.
Figure 3:
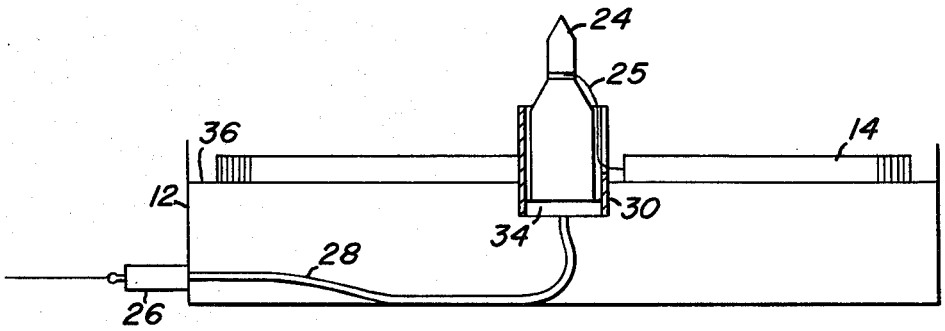
FIG. 3 shows a side view, partly broken away, of the invention.

The ribbon 14 is attached to a known pull type detonator 18 which is attached to a string 20 having a sufficient strength to withstand set-back i.e., 35–50 pounds. The string 20 which could be nylon is secured to the container 12 by a string reel 22 used to prevent the snagging of the string 20. The string 20, of course could be connected directly to the container 12. A small projectile or projecting means 24 which could be a .22 caliber cartridge is attached to a string 25 which is attached to the inner end of ribbon 14 to pull same, upon detonation, from its coiled position, as shown in FIG. 1 to its spiral configuration, as shown in FIG. 2.

In operation, the mine 10 which is firmly secured to the ground, could be activated by a launching means which includes the trip wire of a pull type initiator 26. The tripping of the initiator 26, pulls the initiating powder train, or quickmatch igniter 28, thereby igniting the projectile 24. The projectile then travels up the small well 30 which acts as a launching tube with a slot 32 in the wall of the well 30 to allow the string 25 attached to the projectile 24, to slide freely. A ring 34 holds the powder train 28 to the projectile 24. The coiled ribbon 14 rests on a platform 36 which separates same from the powder train. As projectile 24 travels upwards, in the direction of the arrow in FIG. 2, the coiled ribbon 14 unravels, and when the nylon pull string 20 reaches its most extended position, the set-back forces are survived and the pull type detonator 18 is activated. This activation detonates the explosive ribbon, in a known manner, and causes a rain of fragments in a 360° area. This occurs because each turn of the ribbon 14 will give it a twist yielding a 360° coverage plus an angular distribution up and down.

The size of the fragments may vary in weight up to twenty grains depending on the nature of the target and off route distance of the mine. If material or equipment are the target to be destroyed, then lesser number of heavier fragments are required. Depending upon the fragments employed the lethality would vary but considering a 10–20 grain fragment the casualty radius should be about 10 yards with a danger radius of perhaps 75 yards. Since all fragments are of uniform size and are spaced in such an orientation that would allow for flexibility of the explosive, a victim standing at the outermost range could receive a non-lethal wound. A slight increase in fragment weight and explosive charge would extend the lethal area.

The lethal amount of explosive ribbon 14 required while dependent upon the mission, e.g. anti-personnel or anti-material targets, is also dependent upon the thickness of the sheet. If, for example, the ribbon is made from a twenty-five thousandths inch sheet, then a lethal amount may be as low as one-half pound of explosive or as high as 3 pounds since the length may vary from 8 inches to several feet as well as width which may vary from one-half to 1½ inches.

The matrix of pellets or metal fragments can vary, once again, with the target under consideration and may also vary in shape from a needle to a dart, to a sphere, or a cube. The orientation of these fragments would be such that the ribbon of explosive could maintain its natural flexible state and twist without binding. These fragments could be affixed to either of the two flat surfaces of the ribbon or along the edge and would be suitably placed by means of a compatible adhesive.

Variations of the mine would call for varying thickness of ribbon so that there will be a velocity gradient of the fragments and a nylon filament (not shown) worked into the explosive ribbon to prevent its stretching or tearing.

Obviously, many modifications and variations of the present invention are possible in light of the above teachings. It is therefore to be understood, that within the scope of the appended claims, the invention may be practiced otherwise than as specifically described.

We claim:

1. A mine for firing fragments in a 360° pattern and at a proper burst height, said mine comprising a container, a coiled explosive ribbon seated within said container, a plurality of fragments affixed to said ribbon, projecting means mounted in the center of said explosive ribbon and secured to one end thereof, launching means secured to said projecting means for launching said projecting means vertically in a plane perpendicular to the plane of said coiled explosive ribbon, a detonator secured to the other end of said explosive ribbon, and flexible means connected at one end to said detonator and at the other end to said container, whereupon launching of said projecting means uncoils said explosive ribbon to form a spiral configuration for firing said fragments in said 360° pattern.

2. A mine of the type described in claim 1 wherein said explosive ribbon is composed of a twenty-five thousandths inch thick sheet, having a lethal amount of explosive from one-half pound to 3 pounds, having a length from 8 inches to several feet, and having a width from one-half inch to 1½ inches.

3. A mine of the type described in claim 1 wherein said launching means includes a pull type initiator being secured at one end to a trip wire and on the other end to an initiating powder train, said initiating powder train being connected at its other end to said projecting means.

4. A mine of the type described in claim 2 wherein said projecting means includes a projectile having a primer pocket therein, said projectile being connected to said explosive ribbon.

5. A mine of the type described in claim 2 wherein said initiating powder train is a quickmatch type igniter.

6. A mine of the type described in claim 1 wherein said flexible means includes a nylon string having the strength of 35– pounds.

7. A mine of the type described in claim 4 wherein said explosive ribbon is made of penaerythritol tetranitrate.

8. A mine of the type described in claim 5 wherein each of said fragments does not exceed a weight of twenty grains.

9. A mine of the type described in claim 6 wherein said explosive ribbon contains a nylon filament.

10. A mine of the type described in claim 7 wherein said container is non-metallic.

* * * * *